US008083381B2

(12) United States Patent
Tsai

(10) Patent No.: US 8,083,381 B2
(45) Date of Patent: Dec. 27, 2011

(54) HOLIDAY LIGHT WITH LED

(76) Inventor: George Tsai, Taipei (TW)

( * ) Notice: Subject to any disclaimer, the term of this patent is extended or adjusted under 35 U.S.C. 154(b) by 201 days.

(21) Appl. No.: 12/702,436

(22) Filed: Feb. 9, 2010

(65) Prior Publication Data

US 2011/0194292 A1 Aug. 11, 2011

(51) Int. Cl.
*F21V 3/00* (2006.01)

(52) U.S. Cl. ..... 362/311.02; 362/249.02; 362/800

(58) Field of Classification Search ..... 362/311.02, 362/311.13, 231, 249.16, 249.06, 646, 653, 362/652, 655, 656, 249.02, 800; 439/220, 439/226, 602
See application file for complete search history.

(56) References Cited

U.S. PATENT DOCUMENTS 5,109,324 A * 4/1992 Ahroni ..... 362/249.01
5,121,310 A * 6/1992 Ahroni ..... 362/238
5,517,394 A * 5/1996 Lin ..... 362/353
6,022,241 A * 2/2000 Lin ..... 439/419
6,382,812 B1 * 5/2002 Hsu ..... 362/249.07
6,648,492 B1 * 11/2003 Shih ..... 362/397
7,036,962 B2 * 5/2006 Chan ..... 362/407
7,306,360 B2 * 12/2007 Lin ..... 362/653
7,784,973 B2 * 8/2010 Zhang et al. ..... 362/294
2007/0019416 A1 * 1/2007 Han et al. ..... 362/307
2010/0118550 A1 * 5/2010 Kuo ..... 362/311.02

* cited by examiner

*Primary Examiner* — John A Ward
(74) *Attorney, Agent, or Firm* — Frenkel & Associates, PC

(57) ABSTRACT

A holiday light with LED has a seat connected to a lamp, a lens and a cover in sequence. The seat has lower recesses. The lamp has an LED and two groups of wires and each group of wires have three wires. The cover has upper recesses. The wires are clamped between corresponding lower recesses of the seat and the upper recesses of the cover and the LED is mounted between the seat, the lens and the cover. The holiday light with LED is improved electrical efficiency and provides various lighting effects and is more reliable than an incandescent bulb.

20 Claims, 7 Drawing Sheets

HOLIDAY LIGHT WITH LED

BACKGROUND OF THE INVENTION

1. Field of the Invention

The present invention relates to a holiday light, and more particularly to a holiday light with LED that provides stable and various lighting effects.

2. Description of the Prior Arts

Holiday lights are small colored lights for decoration during festivals, especially during winter. Holiday lights are used to decorate homes, public buildings and trees and come in a dazzling array of configurations and colors.

Conventional holiday lights comprise a string of incandescent lamp holders and light bulbs. However, incandescent light bulbs have low energy efficiency. Besides, an incandescent light bulb only emits one specific color so the lighting effect is tiresome and unexciting or lamp housings in different colors must be used. Moreover, size of incandescent light limits minimization and uses. When incandescent light bulbs are used to decorate outdoors, the incandescent light bulbs are difficult to waterproof so lifetime is reduced.

To overcome the shortcomings, the present invention provides a holiday light with LED to mitigate or obviate the aforementioned problems.

SUMMARY OF THE INVENTION

The main object of the present invention is to provide a holiday light with LED that display stable and various visual effects.

A holiday light with LED in accordance with the present invention comprises a seat connected to a lamp, a lens and a cover in sequence. The seat has lower recesses. The lamp has an LED and two groups of wires and each group of wires have three wires. The cover has upper recesses. The wires are clamped between corresponding lower recesses of the seat and the upper recesses of the cover and the LED is mounted between the seat, the lens and the cover. The holiday light with LED has improved electrical efficiency, provides various lighting effects and is more reliable than an incandescent bulb.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
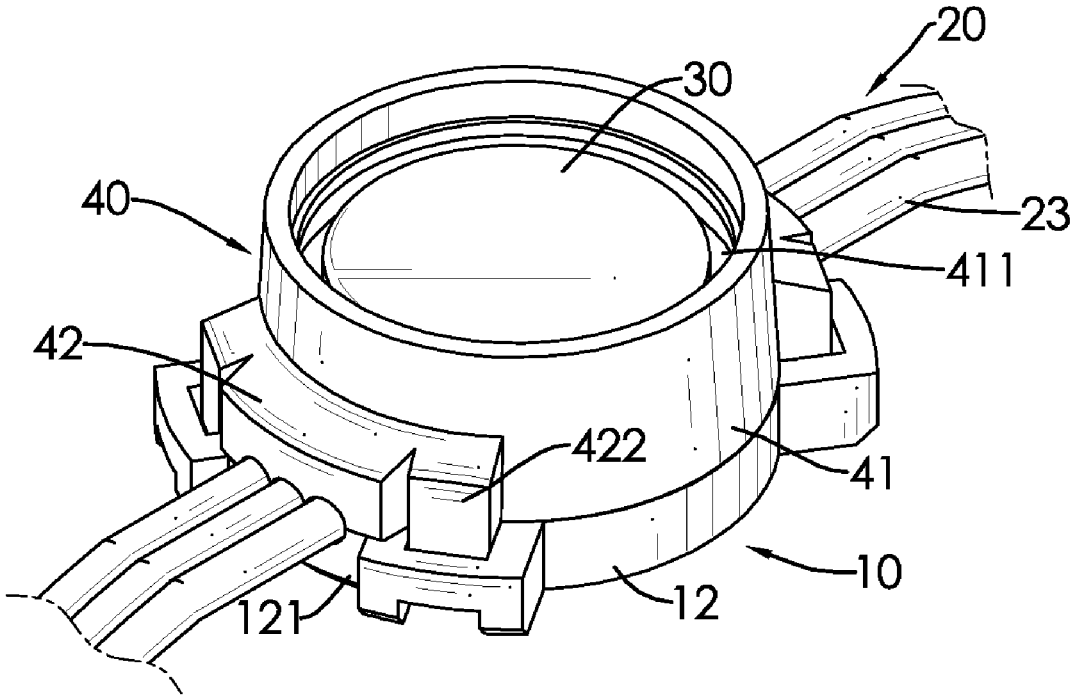
FIG. 1 is a perspective view of a holiday light with LED in accordance with the present invention.
Figure 2:
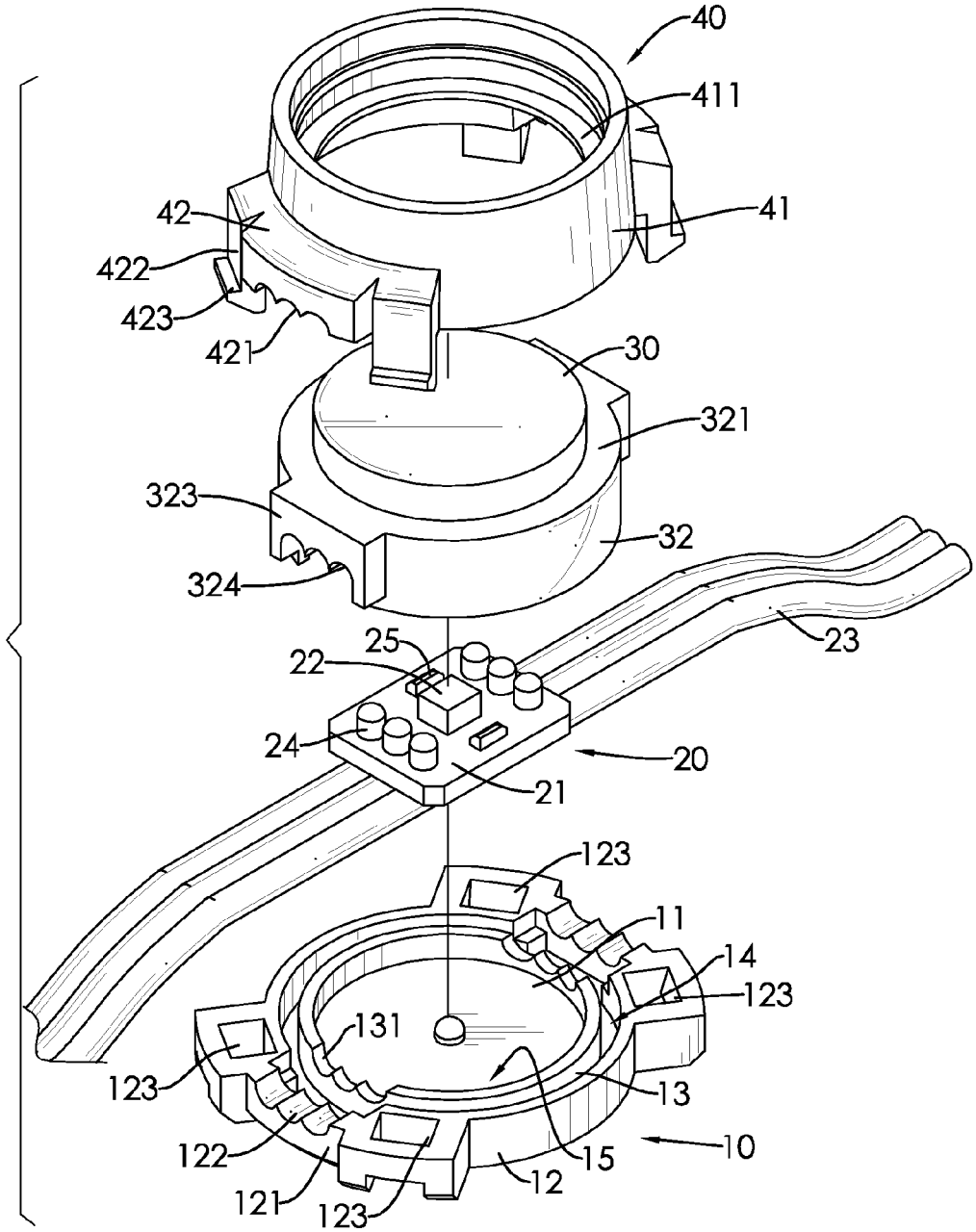
FIG. 2 is an exploded perspective view of the holiday light with LED in FIG. 1.
Figure 3:
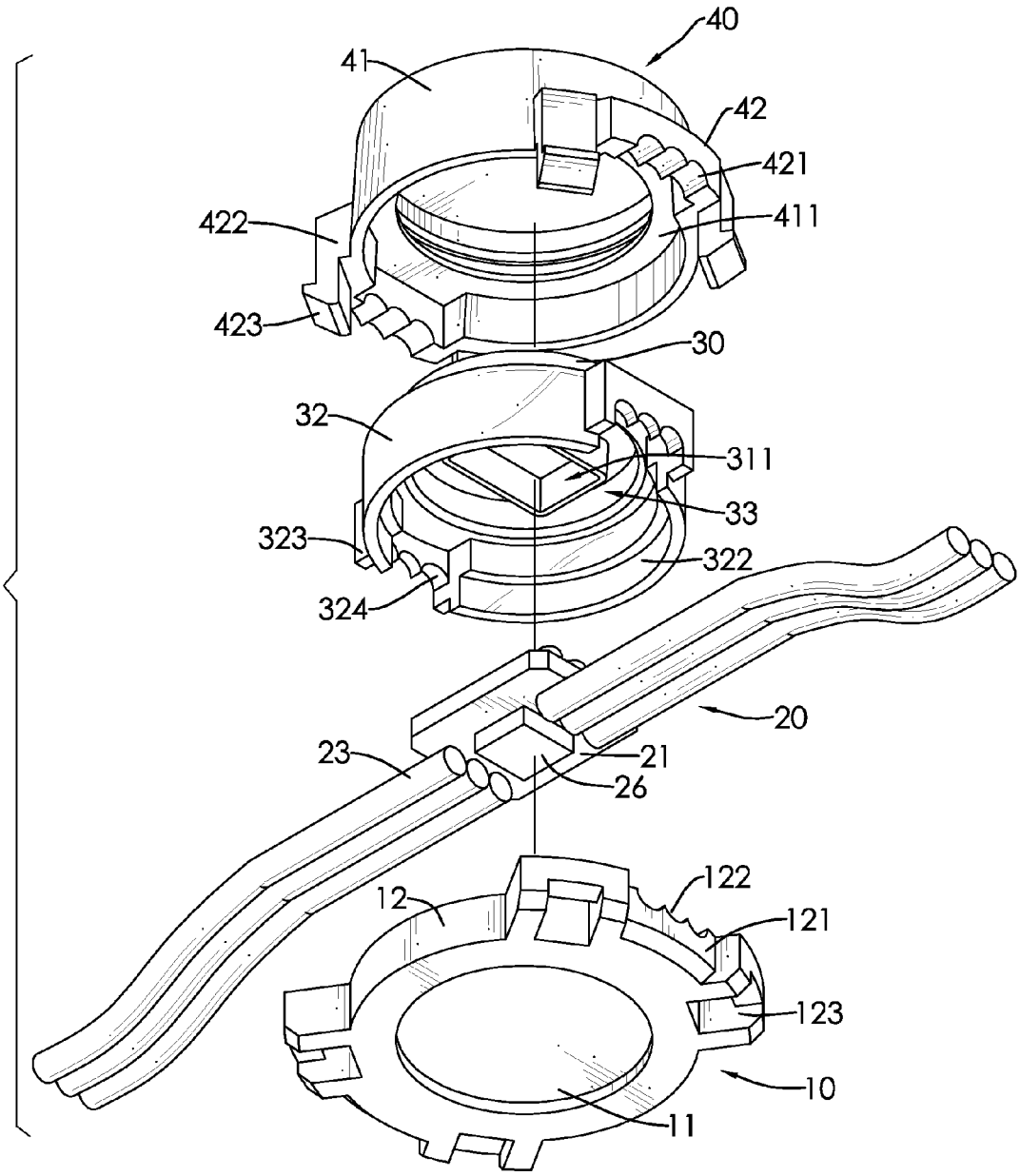
FIG. 3 is another exploded perspective view of the holiday light with LED in FIG. 1.

With reference to FIGS. 1 to 3, a holiday light with LED in accordance with the present invention comprises a seat (10), a lamp (20), a lens (30) and a cover (40).

The seat (10) has a plate (11), an annular outer sidewall (12), an annular inner sidewall (13), an annular groove (14) and a chamber (15). The outer sidewall (12) has an outer surface and two positioning parts (121). The positioning parts (121) are symmetrical and are respectively formed on and protrude transversely from the outer surface of the outer sidewall (12) of the seat (10) and each positioning part (121) has a lower recess (122) and two holes (123). The lower recess (122) of the outer sidewall (12) is wavy and is formed on the upper surface of the positioning part (121). The holes (123) are separately formed through the positioning part (121) on both sides of the lower recess (122). The inner sidewall (13) has an upper surface and two lower recesses (131). The lower recesses (131) of the inner sidewall (13) are wavy, are respectively formed on the upper surface of the inner sidewall (13) and align with the lower recesses (122) of the outer sidewall (12). The groove (14) is defined between the outer sidewall (12) and the inner sidewall (13). The chamber (15) is defined in the inner sidewall (13).

The lamp (20) is connected to the seat (10) and has a printed circuit board (PCB) (21), an LED (22), multiple capacitors (24), multiple resistors (25), a control IC (integrated circuit) (26) and two groups of wires (23). The LED (22) is electrically connected to the PCB (21), is mounted in the chamber (15) of the seat (10), and is an RGB (Red, Green, and Blue) color illuminant that emits light in different colors. The capacitors (24), the resistors (25) and the control IC (26) are respectively electrically connected to the PCB (21). Each group of wires (23) have three wires (23), are electrically connected to the PCB (21) and are mounted through corresponding lower recesses (122,123) of the seat (10).

Figure 4:
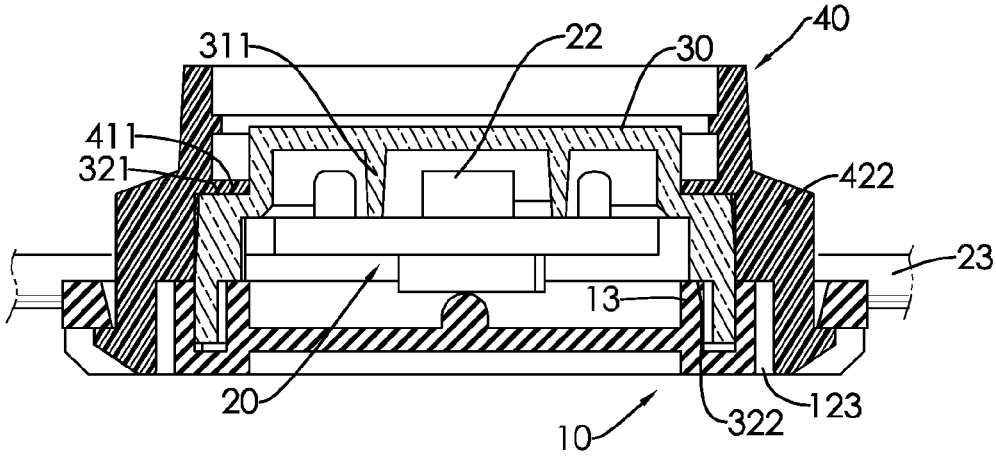
FIG. 4 is a side view in partial section of the holiday light with LED in FIG. 1, showing both lens and cover mounted on a seat securely.
Figure 5:
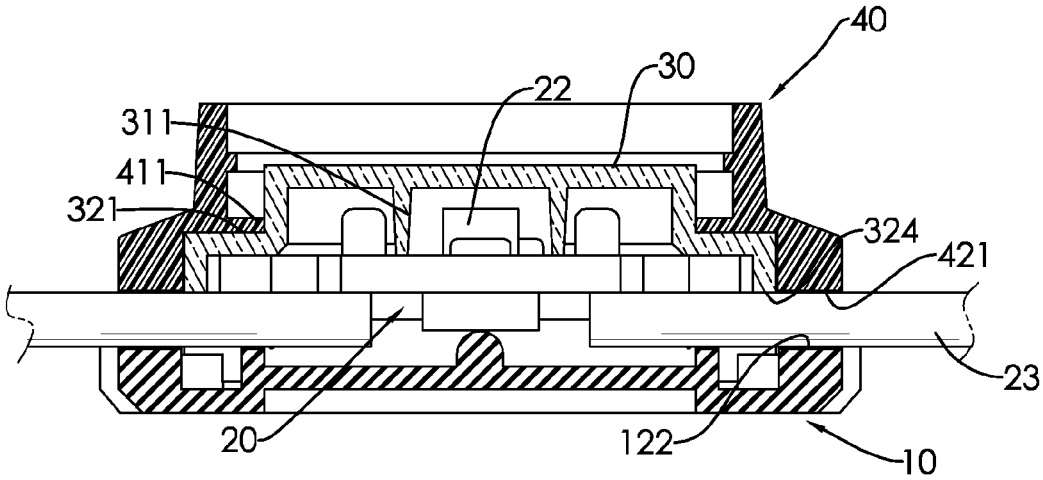
FIG. 5 is a side view in partial section of the holiday light with LED in FIG. 1, showing wires clamped between the seat and the cover.

The lens (30) is mounted on the seat (10) and is mounted over the LED (22), is pervious to light, allows light to refract in different light path and has a lower surface, a center tank (311), an annular sidewall (32) and a space (33). The tank (311) is formed on the lower surface of the lens (30), and the LED (22) is mounted in the tank (311). The annular sidewall (32) is mounted in the groove (14) of the seat (10) and has an upper abutting surface (321), a lower abutting surface (322) and two extensions (323). The lower abutting surface (322) abuts the upper surface of the inner sidewall (13) of the seat (10) as shown in FIG. 4. The extensions (323) are symmetrical and are respectively formed on the outer surface of the sidewall (32) of the lens (30) and each extension (323) has a lower surface and an upper recess (324). The upper recess (324) of the annular sidewall (32) is wavy and is formed on the lower surface of the extension (323). The space (33) is defined in the annular sidewall (32) of the lens (30). Waterproof glue, such as resin or petroleum jelly, is coated in the groove (14) or a gasket made of rubber, PVC (polyvinyl chloride) or other soft materials is mounted in the groove (14) to seal the seat (10) and the lens (30) tightly and prevent water from infiltrating inside the seat (10) and the lens (30) and damaging the LED (22).

Figure 8:
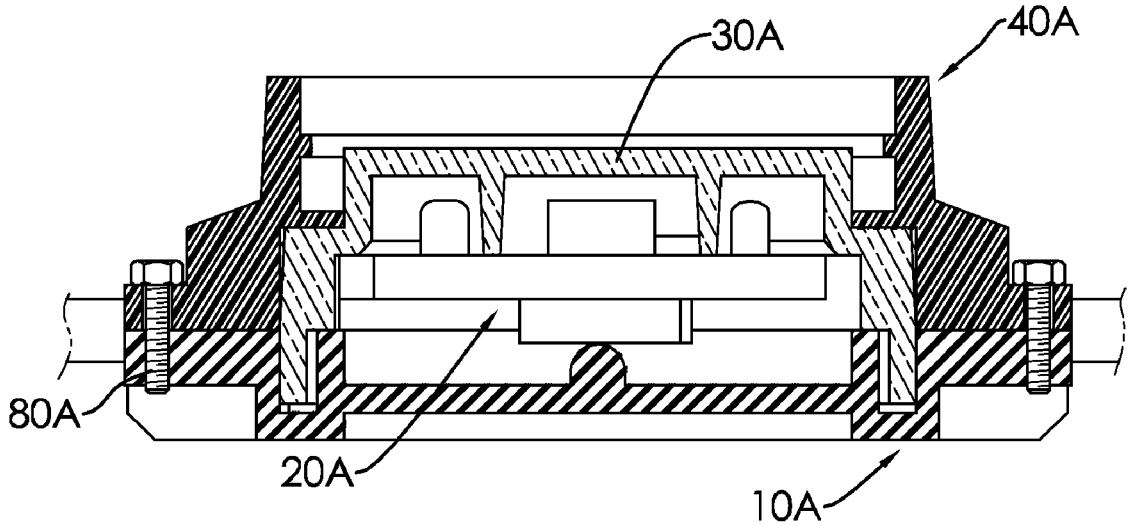
FIG. 8 is a side view in partial section of another embodiment of the holiday light with LED in accordance with the present invention, showing the seat and the cover fastened to each other by fasteners.

The cover (40) is mounted around the lens (30) and connected to the seat (10) and has an annular outer sidewall (41), an outer surface, an inner surface, a flange (411) and two connecting parts (42). The outer sidewall (41) of the cover (40) abuts the outer sidewall (12) of the seat (10). The flange (411) protrudes radially from the inner surface of the outer sidewall (41) of the cover (40) and abuts the upper abutting surface (321) of the lens (30). The connecting parts (42) are symmetrical and are respectively formed on and protrude transversely from the outer surface of the outer sidewall (41) of the cover (40) and each connecting part (42) has a lower surface, an upper recess (421) and two latches (422). The upper recess (421) is wavy, is formed on the lower surface of the connecting part (42) and corresponds to a lower recess (122) of the seat (10). The wires (23) are clamped between corresponding upper recesses (421) of the cover (40) and lower recesses (131) of the seat (10). The latches (422) separately protrude from the connecting part (42) on both sides of the upper recess (421), are detachably mounted through corresponding holes (123) of the seat (10) and each latch (422) has a distal end and a hook (423). The hook (423) is formed on and protrudes from the distal end of the latch (422) and detachably engages a corresponding hole (123) of the seat (10). With further reference to FIG. 8, in another embodiment, the seat (10A) and the cover (40A) are fastened to each other by fasteners (80A) such as but not limited to screws.

Figure 6:
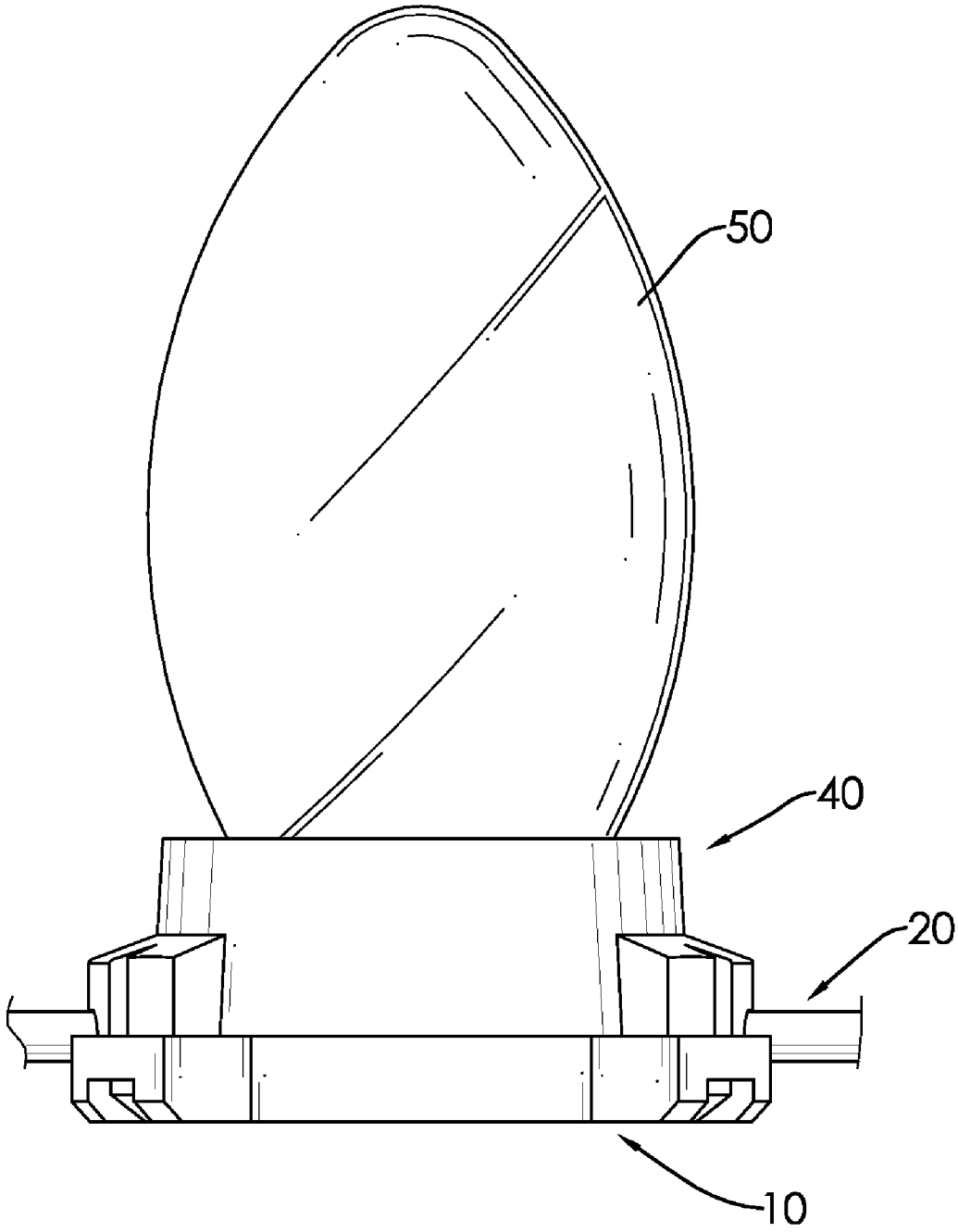
FIG. 6 is a side view of the holiday light with LED in FIG. 1 with a lampshade.

With further reference to FIG. 6, the holiday light with LED in accordance with the present invention may further comprise a lamp housing (50) attached to the cover (40) to provide light of the LED (22) to pass through and generate various lighting effects.

Figure 7:
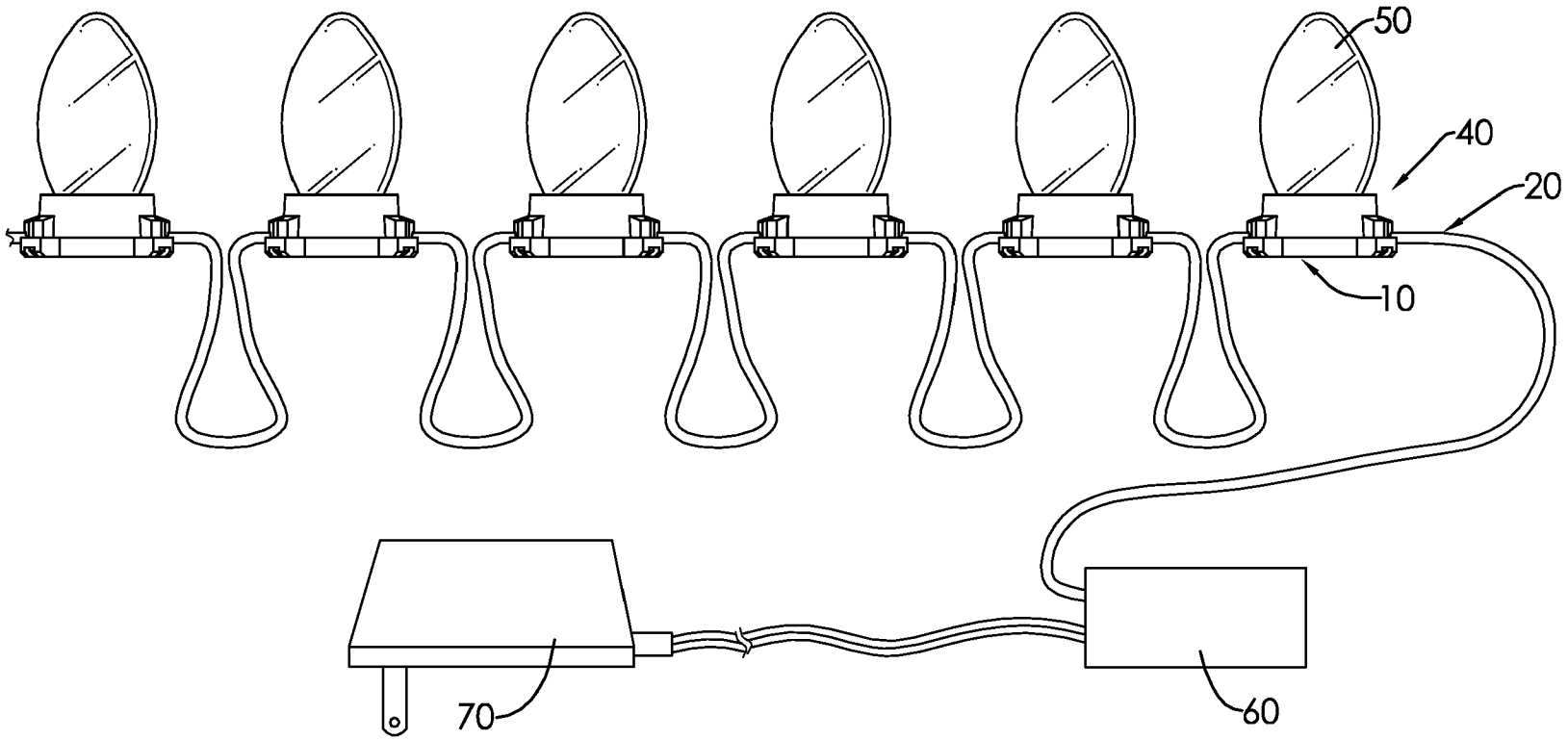
FIG. 7 is an operational side view of multiple holiday lights with LEDs in FIG. 1 with an IC controller and a transformer.

With reference to FIG. 7, multiple holiday lights are generally connected in series to form a holiday light assembly and further comprise an IC controller (60) and a transformer (70). The IC controller (60) is electrically connected to the wires (23). The transformer (70) is electrically connected to the IC controller (60). The IC controller (60) is operated to control the LEDs (22) to light according to a program for aesthetic effects, for instance, light synchronously with a same color, light gradually with different colors and so on. The holiday light assembly is used to decorate homes, public buildings, trees, and has a dazzling array of configurations and colors.

The holiday light with LED presents many advantages over incandescent light strings, including, lower energy consumption, longer lifetime, improved robustness, smaller size, faster switching, and greater durability and reliability.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A holiday light with LED comprising:

a seat having an outer sidewall having two lower recesses; and a chamber;

a lamp mounted on the seat and having a PCB;

an LED electrically connected to the PCB and mounted in the chamber of the seat; and two groups of wires and each group of wires having three wires, electrically connected to the PCB and mounted through corresponding lower recesses of the seat;

a lens mounted on the seat and mounted over the LED; and a cover mounted on the lens and connected to the seat and having an outer sidewall having an upper recess corresponding to the lower recess of the seat, wherein the wires are clamped between corresponding upper recesses of the cover and lower recesses of the seat.

2. The holiday light with LED as claimed in claim 1, wherein the seat further has multiple holes; and the cover further has multiple latches detachably mounted respectively through corresponding holes of the seat and each latch has a distal end; and a hook formed on and protruding from the distal end of the latch and detachably engaging a corresponding hole of the seat.

3. The holiday light with LED as claimed in claim 1, wherein the seat and the cover are fastened to each other by fasteners.

4. The holiday light with LED as claimed in claim 1, wherein the seat further has a groove around the LED; and the lens further has an annular sidewall mounted in the groove of the seat.

5. The holiday light with LED as claimed in claim 2, wherein the seat further has a groove around the LED; and the lens further has an annular sidewall mounted in the groove of the seat.

6. The holiday light with LED as claimed in claim 3, wherein the seat further has a groove around the LED; and the lens further has an annular sidewall mounted in the groove of the seat.

7. The holiday light with LED as claimed in claim 4 further having waterproof glue coated in the groove of the seat.

8. The holiday light with LED as claimed in claim 5 further having waterproof glue coated in the groove of the seat.

9. The holiday light with LED as claimed in claim 6 further having waterproof glue coated in the groove of the seat.

10. The holiday light with LED as claimed in claim 4 further having a gasket mounted in the groove of the seat.

11. The holiday light with LED as claimed in claim 5 further having a gasket mounted in the groove of the seat.

12. The holiday light with LED as claimed in claim 6 further having a gasket mounted in the groove of the seat.

13. The holiday light with LED as claimed in claim 1, wherein the LED is an RGB color illuminant.

14. The holiday light with LED as claimed in claim 2, wherein the LED is an RGB color illuminant.

15. The holiday light with LED as claimed in claim 3, wherein the LED is an RGB color illuminant.

16. The holiday light with LED as claimed in claim 1 further having a lamp housing attached to the cover.

17. The holiday light with LED as claimed in claim 2 further having a lamp housing attached to the cover.

18. The holiday light with LED as claimed in claim 3 further having a lamp housing attached to the cover.

19. The holiday light with LED as claimed in claim 1 further having an IC controller electrically connected to the wires.

20. The holiday light with LED as claimed in claim 19 further having a transformer electrically connected to the IC controller.

* * * * *